US010130977B1

(12) United States Patent
McClelland

(10) Patent No.: US 10,130,977 B1
(45) Date of Patent: Nov. 20, 2018

(54) ELEVATED POTABLE WATER TANK AND TOWER ROTARY CLEANING SYSTEM

(71) Applicant: Joseph James McClelland, Mount Vernon, IL (US)

(72) Inventor: Joseph James McClelland, Mount Vernon, IL (US)

( * ) Notice: Subject to any disclaimer, the term of this patent is extended or adjusted under 35 U.S.C. 154(b) by 41 days.

(21) Appl. No.: 15/253,308

(22) Filed: Aug. 31, 2016

Related U.S. Application Data

(60) Provisional application No. 62/212,067, filed on Aug. 31, 2015.

(51) Int. Cl.
*B08B 9/08* (2006.01)
*B08B 5/04* (2006.01)

(52) U.S. Cl.
CPC ..... *B08B 9/0856* (2013.01); *B08B 5/04* (2013.01)

(58) Field of Classification Search
CPC ..... B08B 9/0933; B08B 9/093; B08B 9/08; B08B 9/0936; B01D 21/245
USPC ..... 134/167 R, 22.18, 22.1, 166 R, 21, 10, 134/168 R, 24, 104.4, 22.12, 175, 186; 15/246.5, 1.7, 302, 3, 321, 345, 304, 315, 15/322, 409; 210/532.1, 528, 767, 523, 210/172.2, 416.1; 137/590, 342, 15.04, 137/123, 14, 15.05
See application file for complete search history.

(56) References Cited

U.S. PATENT DOCUMENTS 320,180 A * 6/1885 Scudder ..... B08B 9/0933 15/246.5
548,138 A * 10/1895 Prather ..... B08B 9/0933 15/246.5
787,266 A * 4/1905 Bivins ..... B08B 9/0933 15/246.5
1,127,354 A * 2/1915 Eckliff ..... F22B 37/54 122/383
1,383,433 A * 7/1921 Smith ..... B08B 9/0933 210/533
1,528,655 A * 3/1925 Christian ..... B08B 9/0933 220/563
1,607,669 A * 11/1926 Foster ..... B08B 9/0933 137/577.5
1,616,218 A * 2/1927 Force ..... B08B 9/0933 210/542
1,616,372 A * 2/1927 Janson ..... F22B 37/54 122/383

(Continued)

*Primary Examiner* — David G Cormier
*Assistant Examiner* — Thomas Bucci
(74) *Attorney, Agent, or Firm* — Grace J. Fishel

(57) ABSTRACT

A system for vacuuming out sediment when installed on the inside of a gravity feed, elevated potable water tank or tower holding water at a pressure head of the kind having a riser serving as a water inlet and outlet. The system having a rotating manifold driven by a rotational drive mechanism installed along the bottom wall of the tank or tower connected to a plurality of downwardly directed nozzles. The rotating manifold is connected to a drain pipe passing down through the or alongside the tank riser and is supported so that the nozzles are positioned above the bottom wall in the vicinity of the sediment. When water is allowed to flow through the drain pipe, the pressure head causes sediment which may otherwise be a health risk and promote electrolytic corrosion to be vacuumed out by the nozzles.

14 Claims, 6 Drawing Sheets

(56) References Cited

U.S. PATENT DOCUMENTS 1,625,721 A * 4/1927 Hahn ..... B08B 9/0933 15/246.5
1,635,539 A * 7/1927 Coleman ..... B08B 9/0933 15/246.5
1,668,063 A * 5/1928 Force ..... B08B 9/0933 134/177
1,694,668 A * 12/1928 Peters ..... B08B 9/0933 210/172.2
1,773,930 A * 8/1930 Athon ..... B08B 9/0933 220/565
1,821,503 A * 9/1931 Erdman ..... B08B 9/0933 137/591
1,978,015 A * 10/1934 Erdman ..... B08B 9/0933 134/170
2,045,752 A * 6/1936 Butterworth ..... B08B 9/0933 134/168 R
2,143,441 A * 1/1939 Jacobs ..... B08B 9/0933 134/104.4
2,552,452 A * 5/1951 Phillips ..... B08B 9/0933 210/177
2,570,603 A * 10/1951 Shoemaker ..... B08B 9/0933 15/246.5
3,235,083 A * 2/1966 Sontheimer ..... B01D 21/04 209/156
3,586,294 A * 6/1971 Strong ..... B01D 21/02 366/163.2
4,024,881 A * 5/1977 Weiland ..... B01D 21/2472 134/104.4
4,364,776 A 12/1982 McBride et al.
4,409,746 A * 10/1983 Beck ..... B08B 9/08 37/195
4,427,553 A * 1/1984 Fore ..... F28F 25/04 134/22.18
4,477,939 A * 10/1984 White ..... B01D 21/245 134/104.4
4,770,711 A * 9/1988 Deal, III ..... B08B 9/0933 134/168 R
4,828,625 A * 5/1989 Moran ..... B08B 9/0933 134/168 R
4,839,064 A * 6/1989 McBurney ..... A47L 7/0014 134/21
4,913,819 A * 4/1990 Patterson ..... B01D 21/2466 134/166 R
5,065,781 A * 11/1991 Cox ..... B08B 9/0933 134/113
5,087,294 A * 2/1992 Rechtzigel ..... B65D 88/34 134/167 R
5,279,012 A * 1/1994 Sloan ..... B08B 9/0933 15/1.7
5,582,652 A * 12/1996 Robertson ..... B08B 9/0933 134/22.1
5,613,510 A * 3/1997 Proctor ..... B08B 9/093 134/166 R
5,657,782 A * 8/1997 Berning ..... B08B 9/0933 134/167 R
5,671,771 A 9/1997 Brandel
5,876,512 A * 3/1999 Desormeaux ..... B08B 9/0933 134/22.18
6,125,865 A * 10/2000 Bacon Cochrane .. B08B 9/0933 134/169 R
6,142,160 A * 11/2000 Winslow ..... B08B 9/0933 134/168 R
6,217,207 B1 4/2001 Streich et al.
7,087,175 B2 8/2006 Mackrle et al.
7,210,488 B2 5/2007 Desormeaux
7,261,109 B2 * 8/2007 Luke ..... B08B 3/024 134/113
7,690,066 B2 4/2010 Stoltz et al.
7,959,741 B2 6/2011 Green
8,852,355 B1 * 10/2014 McClelland ..... B08B 3/02 134/10
2004/0226587 A1 * 11/2004 Lemire ..... B08B 9/093 134/99.1
2004/0238009 A1 * 12/2004 Falster-Hansen ..... B08B 9/08 134/22.1
2006/0130879 A1 * 6/2006 Desormeaux ..... B08B 9/0933 134/22.18
2007/0205164 A1 * 9/2007 Mijatovic ..... B08B 9/0933 210/767
2007/0221565 A1 * 9/2007 Benscoter ..... B01D 35/027 210/416.3
2010/0206343 A1 * 8/2010 Sakamoto ..... B05C 3/04 134/167 R
2011/0180152 A1 * 7/2011 Dorsch ..... B01F 5/0206 137/15.05
2011/0303249 A1 * 12/2011 Ligiero Vargas J nior ..... B08B 9/0933 134/167 R
2013/0026306 A1 1/2013 Mominee et al.

* cited by examiner

ELEVATED POTABLE WATER TANK AND TOWER ROTARY CLEANING SYSTEM

BACKGROUND OF THE INVENTION

1. Field of the Invention

The present invention relates to a system for vacuuming out sediment from a potable gravity water tank or tower without any disruption in service.

2. Brief Description of the Prior Art

Most water storage tanks and towers are not designed to be cleaned and have no "drain pipe" or "washout pipe." But the fact is that all water tanks and towers accumulate sediment in time which becomes a safe habitat for bacteria, protozoa and viruses. In time, the layer of sediment can grow from inches to several feet thick. This is health problem because water flows in and out of the tank through the same pipe in the bottom hence we drink from the bottom of the tank. In addition to being a health risk, sedimentation promotes electrolytic corrosion which naturally occurs in metal tanks over time due to electrical imbalances between the water and the conductive tank material. While water tanks are painted to resist corrosion, sedimentation promotes the passage of electrical current between the negatively charged metal and positively charged water, which can eat through the paint. While corrosion poses no threat to water quality, it does pose a threat to a tower's structural integrity at the bottom of the water tank which is subjected to the greatest pressure and where corrosion can least be afforded.

While some states require water storage tanks and towers to be inspected; only Florida currently requires them to be cleaned. Inspection and cleaning are not the same. Inspection may consist of putting an underwater camera inside the tank to check for structural soundness of the roof and walls and for the condition of the paint without paying attention to the sediment on the floor. Traditionally cleaning has required draining the tank or tower and sending a crew inside with buckets and shovels. Shovels are hard on the painted surface and even the most dedicated crew cannot get cannot get all of the sediment off the floor. In addition, draining the tower and attaching the water pump directly to the water system may cause breaks in the transmission lies which in some cases are older than the tower. Breaks may result in boil orders and require digging up the lines at additional cost and inconvenience.

Another way to clean out a tank or tower is with a pressure washer which also requires draining the tank. Workers are sent into the tank where they flush the sediment down the water inlet pipe as there is nowhere else for it to go. Hence the sediment that is flushed down the pipe is pumped right back up into the tank when the tank or tower is put back into service. Both the bucket and shovel method and pressure washing require putting the tank or tower out of service for some period of time.

Presently, the only way to clean out the sediment without disrupting service is by sending a diver into the tank. To keep the water potable, the diver must be washed down with a chlorine solution. The diver can then enter the tank or tower and vacuum loose sediment from the floor. This leaves the tank much cleaner than pressure washing or the tradition bucket and shovel method but it is dangerous, requires equipment that is only used in potable water and expensive. It is also not legal in some states.

Municipal budgets are frequently stretched in poorer or less populated communities and since tank and tower cleaning is not federally or state mandated, not done. Elected officials may vote to clean or repaint the exterior of a water tank or tower without considering the inside condition, as out of sight is out of mind, but serious illnesses may occur when an event scours disease laden sediment into the distribution system (e.g., fire flow, poor operation, power outages, etc.) and sediment presents a health hazard to susceptible individuals at all times and a risk to the public in general. In addition, sediment also promotes electrolytic corrosion in the bottom of the tank which may put the tower at risk of rusting through.

BRIEF SUMMARY OF THE INVENTION

In view of the above, it is an object of the present invention to provide a system for vacuuming out sediment from an elevated potable water tank or tower without any disruption in service. It is another object to provide a cleaning system that does not require sending a man up the tower or into the tower to initiate cleaning and which is within the budget of most communities to install and maintain. It is also an object to provide a cleaning system that is effective at removing sediment before it has time to build into a dangerous layer which is both a health risk and a corrosion promoter. Other objects and features of the invention will be in part apparent and in part pointed out hereinafter.

The present invention is for use in an elevated potable water tank or tower wherein an accumulation of sediment occurs along the bottom and lower wall surfaces. The water tank or tower holds water at a pressure head and is of the kind having an inlet riser pipe which serves as a water inlet and outlet. The system for vacuuming out the sediment includes a rotating manifold installed along the bottom wall of the tank or tower which is connected to one or more downwardly directed nozzles. The rotating manifold is supported above the bottom wall such that the nozzles are positioned above the bottom wall in the vicinity of the sediment. The rotating manifold is connected to an upper drain pipe which is connected to and in fluid communication with the upper rotating portion of a rotary pipe swivel. A lower drainpipe is connected and in fluid communication to the bottom non-rotating portion of the rotary pipe swivel. The upper and lower portions of this rotary pipe swivel is made and sealed in such a way that it allows the upper drain pipe and the rotating manifold to rotate while staying in fluid communication with the non-rotating lower drain pipe without leakage. The lower portion of the rotary pipe swivel and/or the lower drain pipe is held inside or above the water towers riser pipe by a riser pipe mount. The rotating manifold, upper drain pipe, rotary pipe swivel and the lower drain pipe extends through the riser pipe to a valve for controlling the flow of water through the lower drain pipe. The nozzles and rotating manifold are in fluid communication with the lower drain pipe so that when the valve is open the pressure head in the tank or tower causes the nozzles to vacuum out the sediment as water flows through the drain pipe into a sediment settling tank. In addition there is a rotary drive mechanism which rotates the rotating manifold and the nozzles around the bottom wall of the water tank. This rotary drive mechanism consists of an electric rotary motor mounted on the top of the water tank. The motor output shaft protrudes inside of the water tank and is connected to the rotating manifold. As the electric rotary motor rotates, it causes the nozzles to sweep across near the bottom surface of the water tank to vacuum out the sediment as water flows through the drain pipe into a sediment settling tank as described above.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
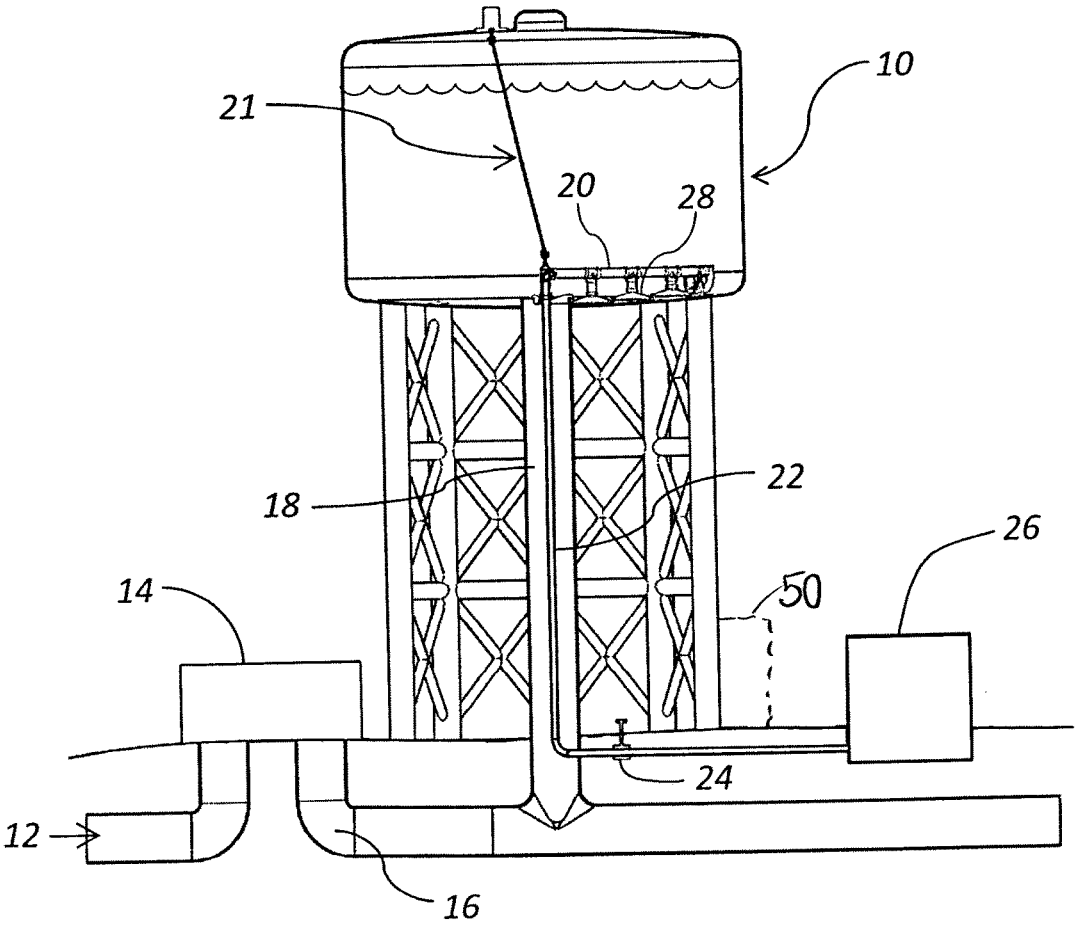
FIG. 1 is a diagrammatic elevational view partly broken away of an elevated water tower with a rotating manifold and rotating drive mechanism for vacuuming out sediment.

Referring to the drawings more particularly by reference character a multi-legged elevated potable water tower 10 is shown in FIG. 1. As shown, water from a well or water treatment plant 12 is pressurized by pump 14 which sends the water into the water system's primary feeder line 16. Water tower 10 is connected to primary feeder line 16 as shown in the diagram and water flows up a riser 18 into the tank through an inlet in the bottom wall of the tank. After the tank is pumped full, the pump and the well may be shut down allowing the pump and the well to rest and recover. Filled water tank 10 stores water and maintains a pressure head, typically between 50 and 120 PSI, in the water system and must be tall enough to supply that level of pressure into feeder line 16 which is connected to the users of the system. In hilly regions, a water tower may be a tank located on a hill and for that reason the terms water tower and water tank are used interchangeably in the following description. Depending on the community's demand for water, the cycle of filling and draining the tank through the riser pipe may repeat several times a day which is a reason that a tank will accumulate sediment as quickly as it does.

The present system for vacuuming out sediment may be used in gravity tanks such as multi-legged towers, pedispheres, fluted column water towers, standpipe water towers, etc. As shown in FIG. 1, a rotating manifold 20 with its downwardly directed nozzles 28 which are more particularly described below is provided in the bottom of water tower 10 for vacuuming out sediment. Rotating manifold 20 is attached to a drain pipe 22 which may be installed inside riser pipe 18. Lower drain pipe 22 exits riser pipe 18 under control of a valve 24. While shown at the base, it will be understood that valve 24 may be a no-freeze valve and may be located anywhere in lower drain pipe 22. Rotary drive mechanism 21 is attached to and rotates the rotating manifold 20 and its downwardly directed nozzles 28. With continuing reference to FIG. 1, water laden with sediment exiting lower drain pipe 22 may be fed into a settling tank 26 if required by federal, state or local regulations. The sediment in settling tank 26 may be cleaned out from time to time and the sediment hauled to a disposal site.

Figure 2:
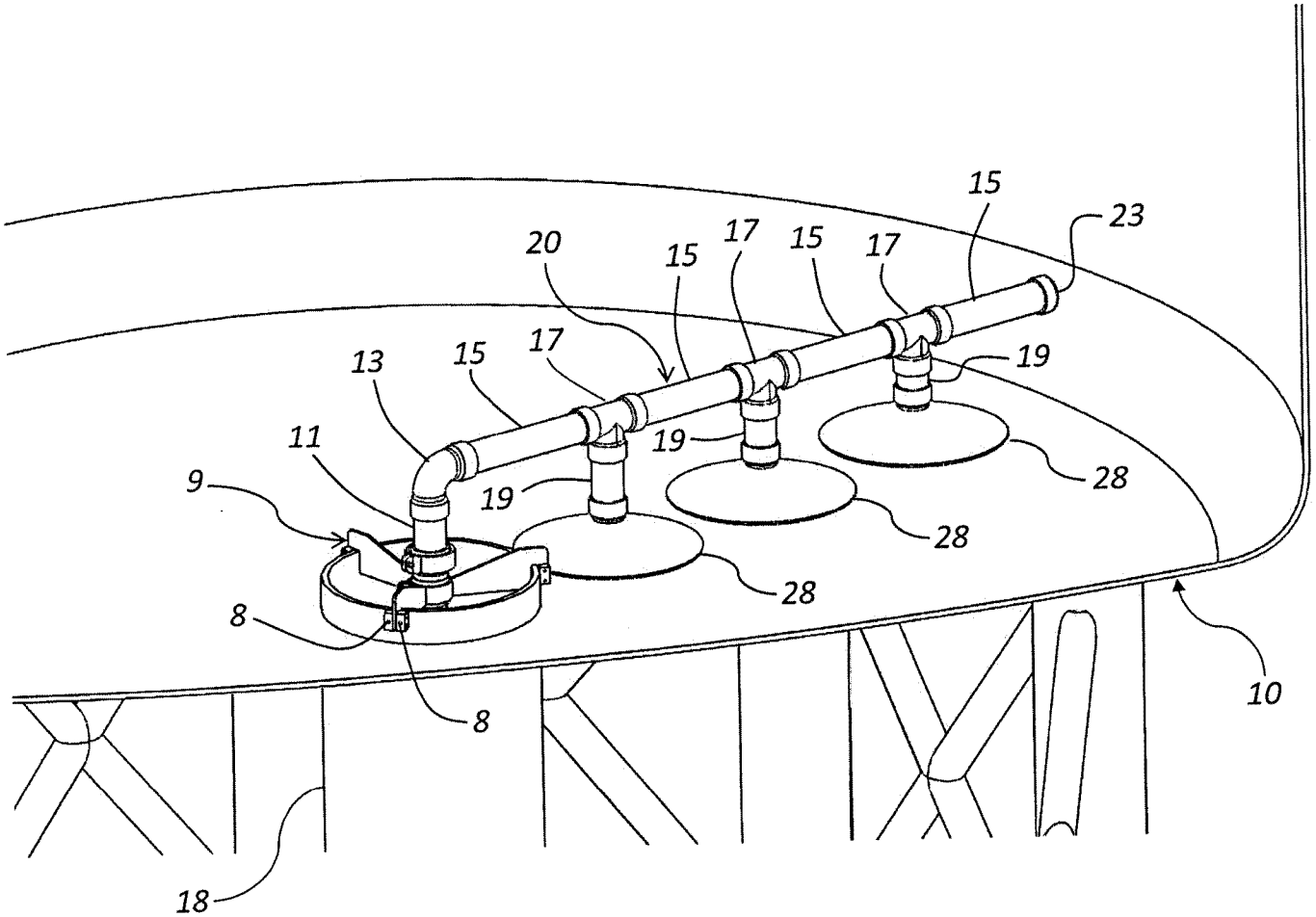
FIG. 2 is a partial perspective view partly broken away of the water tank showing the rotating manifold and swivel mount.

Turning to FIG. 2 is should be noted that the rotary drive mechanism mentioned above and detailed below has been omitted for clarity. As such, the rotating manifold 20 is positioned along a bottom wall of water tower 10 and is flowably connected to a plurality of downwardly directed nozzles 28 which may have a cowbell or trumpet shape or be any shape otherwise flared or cylindrical, square or rectangular. Rotating manifold 20 is supported above the bottom wall above the riser pipe 18 by swivel mount 9 such that nozzles 28 are positioned above the bottom wall in the vicinity of the sediment. The pressure head in water tower 10 causes sediment to be vacuumed out of the tank or tower by the nozzles 28 when valve 24 allows water to flow through lower drain pipe 22. It should be understood that the number, placement, size and shape of the rotating manifolds and the downwardly directed nozzles could vary from the preferred embodiment shown herein without deviating from the intent of the invention.

Figure 6:
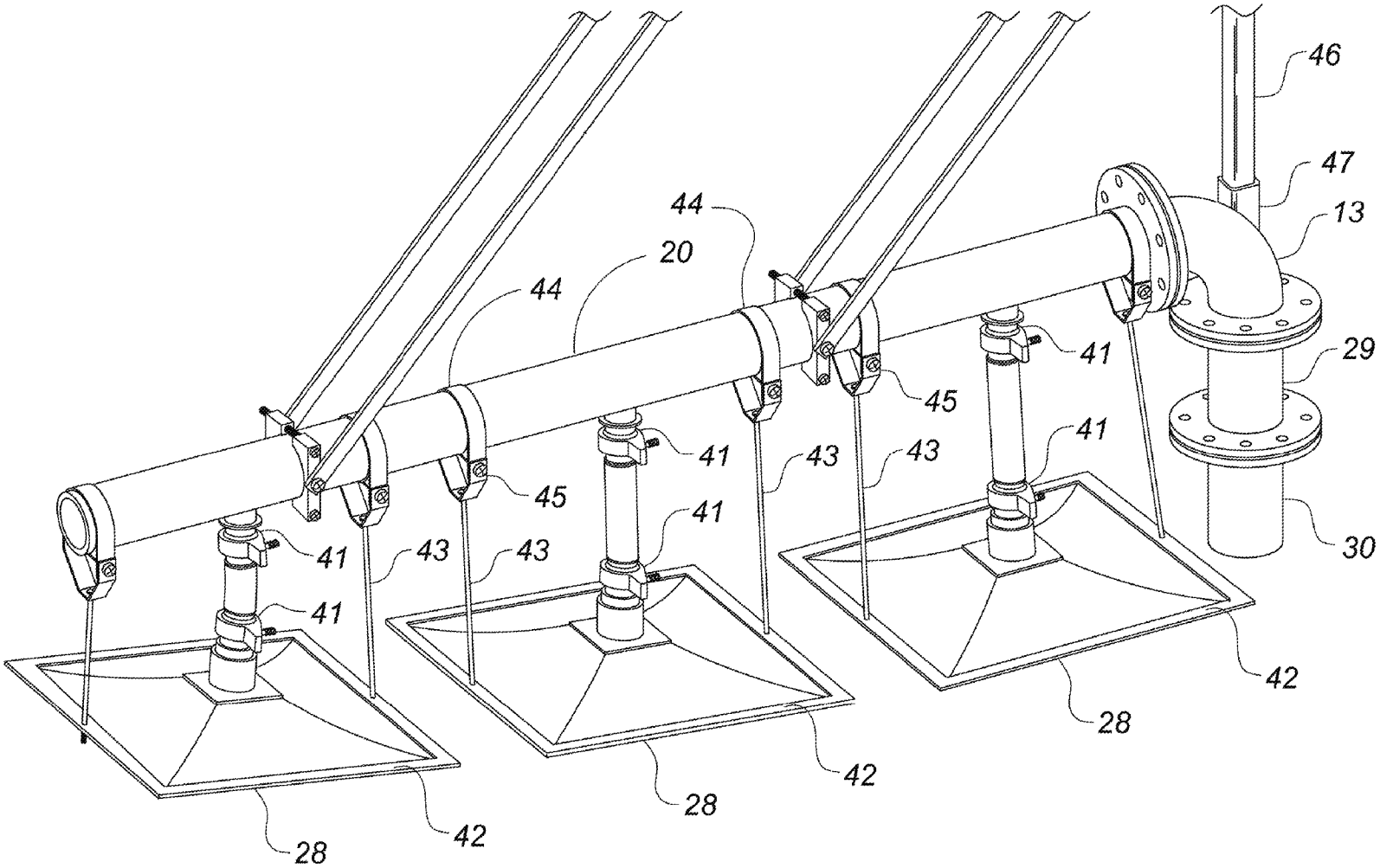
FIG. 6 is a partial perspective view partly broken away showing another embodiment of the rotating manifold and rotary drive mechanism.

Referring now to FIG. 6, downwardly directed nozzles 28 are generally square and include rubber hose connections 41 at the top and bottom 14 so that the nozzles are flexibly connected to the rotating manifold 20. Nozzles 28 includes a frame 42 which is attached by threaded rods 43 to pipe hangers 44 on the rotating manifold 20. Pipe hangers 44 may be slid along the rotating manifold 20 for spacing of nozzles 20 on the rotating manifold. Once positioned, bolts 45 may be used to fix pipe hangers 44 and nozzles 28 on the rotating manifold 20. Threaded rods 43 permit the angle of nozzles 28 with respect to the rotating manifold 20 to be adjusted to the curvature of the bottom wall of the water tower 10.

Preferably the swivel mount 9 is made so that it is removable from the riser pipe 18 so as to facilitate the easy assembly, disassembly, inspection and repair of the elevated potable water tank and tower rotary cleaning system. As such, this depiction of the swivel mount 9 incorporates six radially placed screw clamps 8 that can be tightened to affix the swivel mount to the top of the riser pipe 18 but it could take other forms and use other fastening means without deviating from the intent of the invention. It should be noted that the swivel mount could also be mounted on the bottom surface of the water tank 10 without deviating from the intent of the invention. As illustrated, rotating manifold 20 may be formed of standard PVC pipe segments connected with standard PVC pipe couplings were downwardly directed nozzles 28 are attached. The rotating manifold is comprised of a first vertical pipe segment 11. An elbow coupling 13 is flowably connected to vertical pipe segment 11 and also to laterally extending conduit 15 which is flowably connected to tee coupling 17. The vertical portion of tee coupling 17 is flowably connected to second vertical pipe segment 19 which is flowably connected to nozzles 28. Multiple repeated segments of laterally extending conduits 15, tee couplings 17, vertical pipe segments 19 and nozzles 28 can be utilized to accommodate different sizes and shapes of water tanks. It is also understood that laterally extending conduits 15 and vertical pipe segments 19 can be of different lengths and diameters and may even be slightly curved so that nozzles 28 are optimally positioned in the vicinity of the sediment above the bottom wall of the tank 10 without deviating from the intent of the invention. The end of the lateral extending conduits 15 are fluidly closed which may be accomplished by pipe end cap 23.

Figure 3:
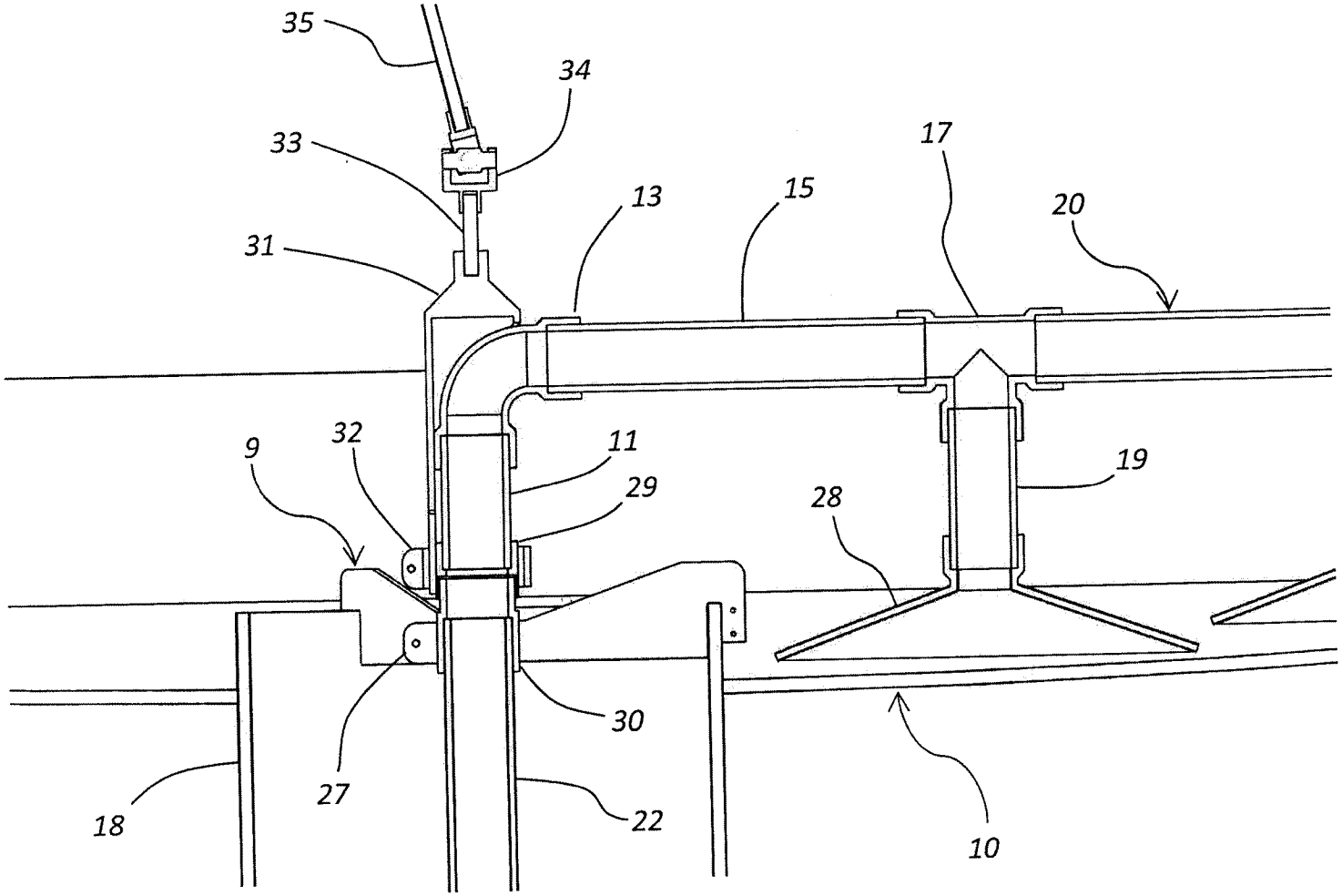
FIG. 3 is a partial diagrammatic view partly broken away showing the swivel mount, pipe swivel and rotary shaft connector and the lower portion of the rotating drive mechanism.

As shown in FIG. 3 the swivel mount 9 is mounted on riser pipe 18. The swivel mount 9 has an integrated clamping collar 27 that clamps it to the lower stationary portion of the rotary pipe swivel 30. This lower stationary portion of the rotary pipe swivel 30 is also fluidly connected to lower drain pipe 22. The upper portion of the rotary pipe swivel 29 and lower portion of the rotary pipe swivel 30 is made and sealed in such a way that it allows the rotating upper drain pipe 11 to rotate while staying in fluid communication with the non-rotating lower drain pipe 22 without leakage. The upper portion of the rotary pipe swivel 29 is also connected to a rotary shaft connector 31 by a clamping collar 32. This rotary shaft connector 31 connects to lower rotary shaft 33 while allowing room for the vertical pipe segment 11 and the elbow coupling 13 to pass through and exit the rotary shaft connector 31's center. The upper end of lower rotary shaft 33 is connected to the output end of lower universal joint 34. The upper input end of the lower universal joint 34 is connected to the lower end of middle drive shaft 35.

Figure 4:
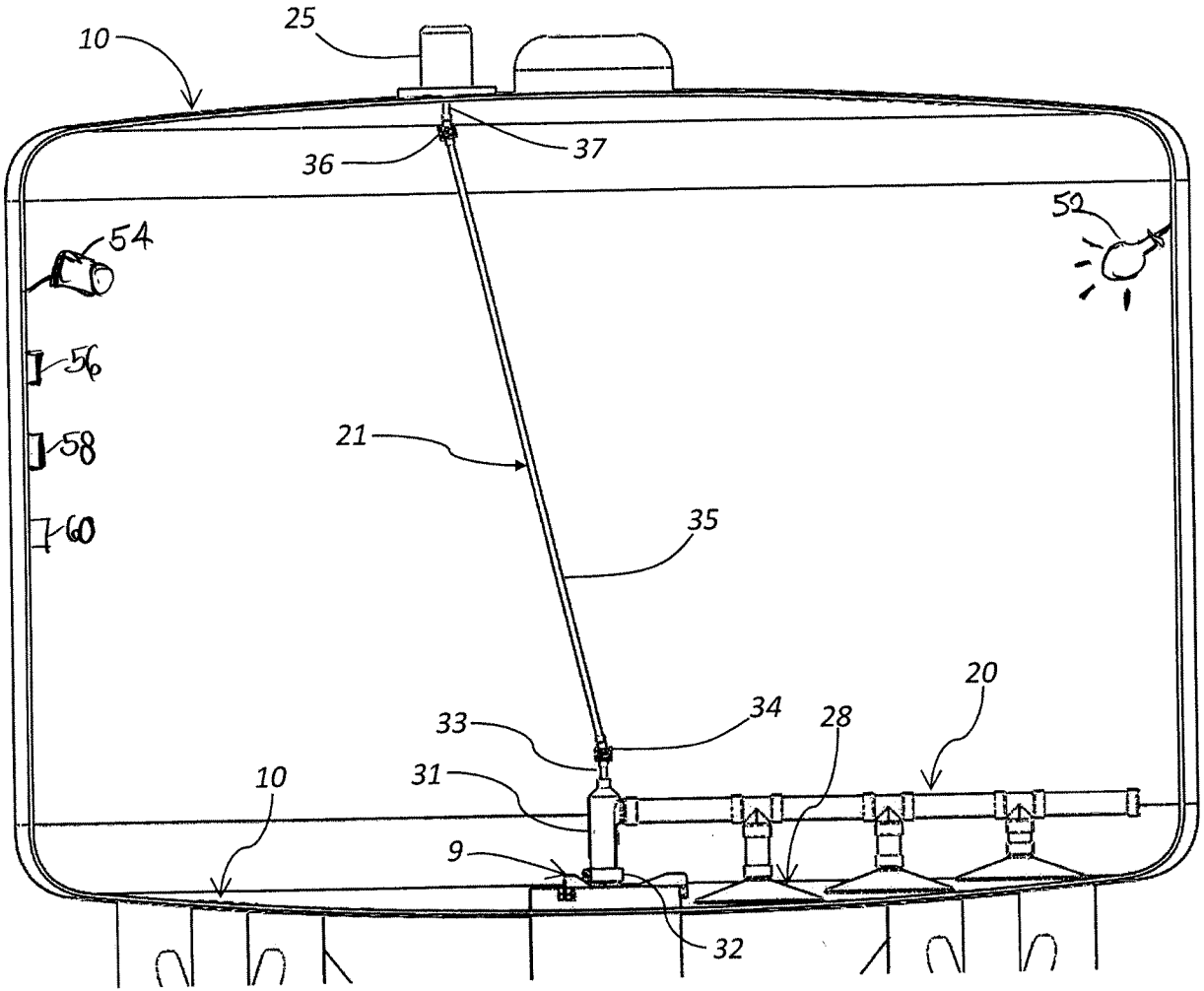
FIG. 4 is a partial perspective view partly broken away of an elevated water tower tank with a swivel mount, rotating manifold and rotating drive mechanism.

As shown in FIG. 4 there is a rotary drive mechanism 21 which rotates the rotating manifold 20 and its nozzles 28 around the bottom surface of the water tank 10 so that the nozzles can vacuum out the sediment around the entire bottom and lower sides of the water tank 10. An electric rotary motor 25 is positioned on top of the water tank. Although the rotary motor could be placed in any another location such as inside of the tank without deviating from the intent of the invention. In addition, the rotational motor drive could be provided by other drive means such as but not limited to a hydraulic motor, Pelton water motor, etc. that are well known to those skilled in the art without deviating from the intent of the invention. In this rotational motor drive iteration, the rotary motor 25 output shaft 37 protrudes into the tank and is connected to the input end of an upper universal joint 36. The output end of this upper universal joint 36 is connected to the upper end of the middle drive shaft 35. The opposite end of the middle drive shaft 35 in connected to the input end of the lower universal joint 34. The output end of this universal joint 34 is connected to a lower drive shaft 33 which is connected to the top of the rotary shaft connector 31. As shown in FIG. 3 the opposite end of this rotary shaft connector 31 is connected to the upper part of the rotary swivel 29 via a bolted clamping collar 32. Therefore as the electric rotary motor 25 rotates, it causes the nozzles 28 to sweep across near the bottom surface of the water tank 10 to vacuum out the sediment as water flows through the drain pipe 22 into a sediment settling tank 26 as described above. Turning to FIG. 6, in other embodiments universal joints 34 and 36 are eliminated with a square drive shaft 46 which is received in a clamping collar 47 with electric drive motor 25 positioned directly above.

Figure 5:
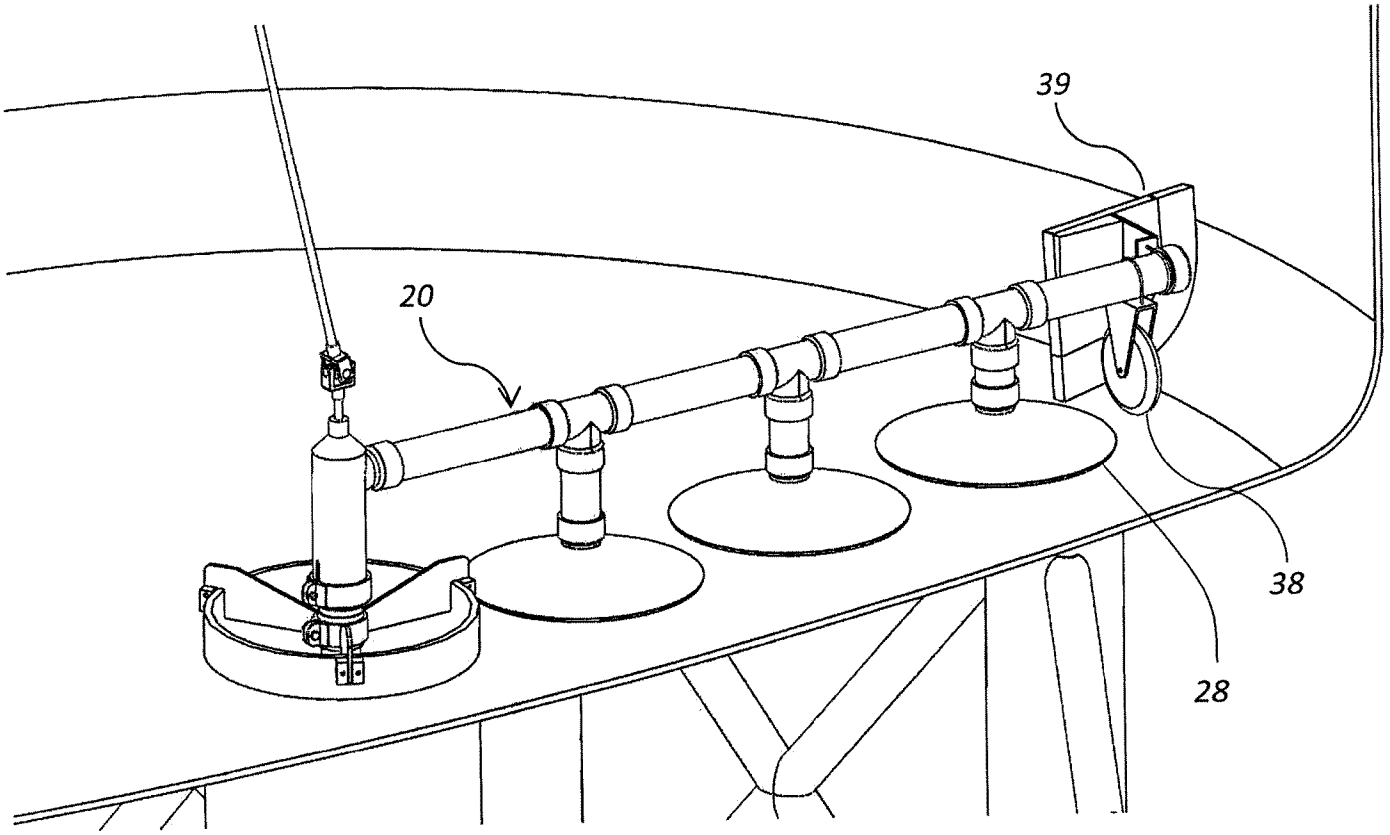
FIG. 5 is a partial perspective view partly broken away of an elevated water tower tank showing the rotating manifold with a supporting wheel and sidewall brush attached.

As shown in FIG. 5 the rotating manifold 20 may also have one or more supporting wheels 38 attached to help support the rotating manifold 20 when stationary and when in rotational operation. These wheels 38 may be attached anywhere along the rotating manifold 20 to best facilitate their use with different tanks sizes and designs. These wheels could also be rotationally driven so as to provide or help to provide the rotary motion necessary to rotate rotating manifold 20. This rotational drive could be provided by various means such as an electric motor, hydraulic motor, Pelton water motor etc. that are well known to those skilled in the art without deviating from the intent of the invention. Also shown in FIG. 5 is a sidewall brush 39. This sidewall brush is used to help to scrub the side of the tank in such a way that it cleans and directs the tanks sidewall sediment towards one or more of the nozzles 28. Like the supporting wheel 38; the invention may utilize any, size, shape, number and placement of brushes to best facilitate their use with different tank sizes and designs.

A controller 50 may be provided at the base of water tower 10 or be remotely positioned. Lights 52 and a camera 54 inside water tower 10 may be turned on remotely such that an operator can visually confirm that the system is operating correctly. With a water tight camera 54, the operator may also confirm that cleaning is proceeding at the bottom of the tank. One or more sensors may also be provided at various water levels in the tank to monitor stratification for temperature 56, pH 58 and chlorine level 60. Data from these sensor readings and output from the camera may be collected and saved as may be required to satisfy federal and/or state water safety requirements.

When valve 24 is open, sediment is vacuumed up by nozzles 28 and is expelled through drain pipe 22. The operator in charge of discharging the sediment does not need to climb tower 10 or be specially trained, just authorized to open valve 24. If this is done on a periodic basis, even poorer or less populated communities or communities with stretched budgets can keep their tanks sediment free thus avoiding possible disastrous discharge of disease laden sediment into the water distribution system. Maintenance costs of the system are also kept low.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. In a gravity feed, elevated potable water tank or tower wherein an accumulation of sediment occurs along a bottom wall surface, said tank or tower having a riser pipe which serves as a water inlet and outlet, said tank or tower holding water at a pressure head, a system for vacuuming out the sediment comprising a rotating manifold along a bottom wall of the tank or tower connected to a plurality of downwardly directed nozzles such that the nozzles are positioned above the bottom wall in the vicinity of the sediment, a drain pipe connected to the rotating manifold driven by a rotary drive shaft and extending through the riser pipe, a valve for controlling flow of water through the drain pipe, said nozzles and manifold in fluid communication with the drain pipe, whereby the pressure head in the tank or tower causes sediment to be vacuumed out of the tank or tower by the nozzles as water flows through the drain pipe.

2. The system of claim 1 further including lights and a camera positioned in the tank or tower such that an operator can monitor operation of the system.

3. The system of claim 1 wherein one or more of a temperature sensor, pH sensor or a chlorine sensor are provided in the tank or tower.

4. The system of claim 1 wherein a spacing of the nozzles along the manifold are adjustable.

5. The system of claim 1 wherein an angle at which the nozzles make with respect to the manifold is adjustable.

6. In a gravity feed, elevated potable water tank or tower wherein an accumulation of sediment occurs along a bottom wall surface, said tank or tower having a riser pipe which serves as a water inlet and outlet, said tank or tower holding water at a pressure head, a system for vacuuming out the sediment comprising a rotating manifold along a bottom wall of the tank or tower connected to a plurality of downwardly directed nozzles such that the nozzles are positioned above the bottom wall in the vicinity of the sediment, a drain pipe connected to the rotating manifold driven by a rotary drive shaft and extending through the riser pipe, said drain pipe connected to a swivel mount with a lower stationary portion connected to the drain pipe and an upper portion that allows a pipe segment to which the rotating manifold is coupled to rotate while saying in fluid communication with the non-rotating drain pipe, a valve for controlling flow of water through the drain pipe, said nozzles and manifold in fluid communication with the drain pipe, whereby the pressure head in the tank or tower causes sediment to be vacuumed out of the tank or tower by the nozzles as water flows through the drain pipe.

7. The system of claim 6 wherein the nozzles are suspended from the manifold on threaded rods connected to pipe hangers on the manifold.

8. The system of claim 6 wherein the rotating manifold is connected to the pipe segment by an elbow coupling and the rotary drive shaft includes a square drive shaft that is received at a lower end in a coupling on the elbow and at an upper end to an electric motor.

9. The system of claim 6 further including lights and a camera positioned in the tank or tower such that an operator can monitor operation of the system.

10. The system of claim 6 wherein one or more of a temperature sensor, pH sensor or a chlorine sensor are provided in the tank or tower.

11. In a gravity feed, elevated potable water tank or tower wherein an accumulation of sediment occurs along a bottom wall surface, said tank or tower having a riser pipe which serves as a water inlet and outlet, said tank or tower holding water at a pressure head, a system for vacuuming out the sediment comprising a rotating manifold along a bottom wall of the tank or tower connected to a plurality of downwardly directed nozzles such that the nozzles are positioned above the bottom wall in the vicinity of the sediment, a drain pipe connected to the rotating manifold driven by a rotary drive shaft and extending through the riser pipe, said drain pipe connected to a swivel mount with a lower stationary portion connected to the drain pipe and an upper portion that allows a pipe segment to which the rotating manifold is coupled by an elbow to rotate while saying in fluid communication with the non-rotating drain pipe, the rotating rotary drive shaft having a square drive shaft that is received at a lower end in a coupling on the elbow and at a upper end to an electric motor, a valve for controlling flow of water through the drain pipe, said nozzles and manifold in fluid communication with the drain pipe, whereby the pressure head in the tank or tower causes sediment to be vacuumed out of the tank or tower by the nozzles as water flows through the drain pipe.

12. The system of claim 11 wherein the nozzles are suspended from the manifold on threaded rods connected to pipe hangers on the manifold.

13. The system of claim 11 further including lights and a camera positioned in the tank or tower such that an operator can monitor operation of the system.

14. The system of claim 13 wherein one or more of a temperature sensor, pH sensor or a chlorine sensor are provided in the tank or tower.

* * * * *